US010861662B2

(12) United States Patent
Hofsaess

(10) Patent No.: US 10,861,662 B2
(45) Date of Patent: Dec. 8, 2020

(54) TEMPERATURE-DEPENDENT SWITCH

(71) Applicant: Marcel P. Hofsaess, Kyffhaeuserland Ortsteil Steintahleben (DE)

(72) Inventor: Marcel P. Hofsaess, Kyffhaeuserland Ortsteil Steintahleben (DE)

( * ) Notice: Subject to any disclaimer, the term of this patent is extended or adjusted under 35 U.S.C. 154(b) by 0 days.

(21) Appl. No.: 16/220,807

(22) Filed: Dec. 14, 2018

(65) Prior Publication Data

US 2019/0221390 A1 Jul. 18, 2019

(30) Foreign Application Priority Data

Jan. 16, 2018 (DE) ..... 10 2018 100 890

(51) Int. Cl.

| | |
|---|---|
| ***H01H 37/54*** | (2006.01) |
| ***H01H 37/74*** | (2006.01) |
| ***H01H 37/70*** | (2006.01) |
| ***H01H 37/52*** | (2006.01) |

(52) U.S. Cl.

CPC ..... *H01H 37/5409* (2013.01); *H01H 37/52* (2013.01); *H01H 37/5427* (2013.01); *H01H 37/70* (2013.01); *H01H 37/74* (2013.01); *H01H 2037/549* (2013.01)

(58) Field of Classification Search

CPC ..... H01H 37/5409; H01H 37/5427; H01H 37/70; H01H 37/52; H01H 37/74; H01H 2037/549

USPC ..... 337/367

See application file for complete search history.

(56) References Cited

U.S. PATENT DOCUMENTS

| | | | | |
|---|---|---|---|---|
| 2,622,169 A | | 12/1952 | Cataldo et al. | |
| 3,925,742 A | * | 12/1975 | Muench | H01H 50/326 335/186 |
| 4,017,137 A | * | 4/1977 | Parks | H01R 25/164 439/135 |
| 4,053,859 A | * | 10/1977 | Hollweck | H01H 37/5409 337/91 |

(Continued)

FOREIGN PATENT DOCUMENTS

| | | |
|---|---|---|
| CN | 103985599 A | 8/2014 |
| CN | 104919558 A | 9/2015 |

(Continued)

OTHER PUBLICATIONS

First Office Action dated Mar. 20, 2020 corresponding to Chinese Application No. 201910042457.1, 13 pages.

*Primary Examiner* — Anatoly Vortman

(74) *Attorney, Agent, or Firm* — Harness, Dickey & Pierce, P.L.C.

(57) ABSTRACT

A temperature-dependent switch has a first and a second stationary counter contact and a temperature-dependent switching mechanism with a contact member. The switching mechanism, in its first switching position, presses the contact member against the first counter contact and, in this case, produces an electrically conducting connection between the two counter contacts via the contact member. The switching mechanism, in its second switching position, holds the contact member at a spacing from the first counter contact. A closing lock is provided, which prevents the switch, once opened, from closing again. The closing lock locks the temperature-dependent switching mechanism permanently in the second switching position thereof in a mechanical manner.

20 Claims, 10 Drawing Sheets

(56) References Cited

U.S. PATENT DOCUMENTS 4,554,525 A * 11/1985 Bayer ..... H01H 37/5409 337/348
4,640,314 A * 2/1987 Mock ..... H02G 3/0418 138/157
4,885,560 A * 12/1989 Niino ..... H01H 37/002 337/3
4,942,271 A * 7/1990 Corsi ..... H02G 3/0418 138/162
5,434,388 A 7/1995 Kralik et al.
5,877,671 A * 3/1999 Hofsass ..... H01H 37/5427 337/333
5,942,729 A * 8/1999 Carlson, Jr. ..... H02G 3/0418 174/66
5,986,535 A * 11/1999 Stiekel ..... H01H 37/5427 337/298
6,191,680 B1 * 2/2001 Hofsass ..... H01H 37/002 337/333
6,249,211 B1 * 6/2001 Hofsaess ..... H01H 1/504 337/333
6,590,489 B1 * 7/2003 Ullermann ..... H01H 9/32 337/112
6,741,159 B1 * 5/2004 Kuczynski ..... H01H 37/002 337/142
RE38,709 E * 3/2005 Gutgsell ..... H02G 3/0418 108/50.02
7,071,809 B2 * 7/2006 Davis ..... H01H 37/5409 337/343
7,209,336 B2 * 4/2007 Yu ..... H01C 7/126 200/400
7,345,568 B2 * 3/2008 Yu ..... H01H 37/002 337/13
8,847,725 B2 * 9/2014 Buettner ..... H01H 37/5427 337/298
9,666,394 B2 5/2017 Kamiyama et al.
9,691,576 B2 * 6/2017 Mitschele ..... H01H 37/34
2004/0100354 A1 5/2004 Davis et al.
2014/0225709 A1 * 8/2014 Kirch ..... H01H 37/72 337/365

FOREIGN PATENT DOCUMENTS

DE 892468 C 10/1953
DE 2544201 A1 4/1977
DE 8625999 U1 11/1986
DE 19623570 A1 1/1998
DE 102007042188 B3 4/2009
DE 102011016142 A1 9/2012
DE 102013101392 A1 8/2014
EP 0591755 A1 4/1994

* cited by examiner

TEMPERATURE-DEPENDENT SWITCH

CROSS-REFERENCE TO RELATED APPLICATION

This application claims priority to German patent application DE 10 2018 100 890.2, filed Jan. 16, 2018, which is incorporated herein by reference.

BACKGROUND OF THE INVENTION

The present invention relates to a temperature-dependent switch which comprises a first and a second stationary counter contact and a temperature-dependent switching mechanism with a contact member, wherein the switching mechanism, in its first switching position, presses the contact member against the first counter contact and, in this case, produces an electrically conducting connection between the two counter contacts via the contact member, and in its second switching position, holds the contact member at a spacing from the first counter contact, wherein a closing lock is provided which prevents a switch that has been opened once from closing again.

Such a switch is disclosed in DE 10 2013 101 392 A1.

The known switch comprises a temperature-dependent switching mechanism with a temperature-dependent bi-metal snap disc and a bistable spring disc which carries a movable counter contact or a current transfer member. When the bi-metal snap disc is heated to a temperature above its response temperature, it lifts the counter contact or the current transfer member from the counter contact or counter contacts against the force of the spring disc and, in this case, presses the spring disc into its second stable configuration in which the switching mechanism is situated in its high-temperature position.

When the switch and consequently the bi-metal snap disc cool down again, said snap disc snaps back into its first configuration. However, due to the design, it is not able to brace with its edge on a counter bearing such that the spring disc remains in the configuration in which the switch is open.

The disclosed switch therefore remains in its open position after being opened once even when it cools down again. However, tests carried out by the company of the Applicant have shown that the disclosed switch does close again in the event of stronger mechanical vibrations such that—under safety aspects—it may not be the perfect solution in some applications.

The switch disclosed in DE 10 2007 042 188 B3 comprises three switching positions. The switch is closed in its low-temperature position so that the two counter contacts are connected electrically to one another.

In its high-temperature position, the switch is open-circuited so that no current is able to flow through the switch. In its cooled-down position, the switch continues to stay open although the snap disc has cooled down again and consequently has re-assumed its low-temperature position.

In this way, the temperature-dependent switch is a one-time switch which after being opened once then also remains open when the temperature of the snap disc has decreased again.

Comparable one-time switches are disclosed in DE 86 25 999 U1 and DE 25 44 201 A.

Such temperature-dependent switches are used in a known manner for the purpose of protecting electrical devices from overheating. To this end, the switch is connected in series to the device to be protected and to the supply voltage thereof and is arranged mechanically on the device such that it is thermally connected to said device.

Below the response temperature of the snap disc, the two counter contacts are connected electrically to one another such that the electrical circuit is closed and the load current of the device to be protected flows through the switch. If the temperature rises above an admissible value, the snap disc lifts off the contact member from the counter contact against the actuating force of the spring disc, as a result of which the switch is opened and the load current of the device to be protected is interrupted.

The now current-less device can then cool down again. In this case, the switch, which is coupled thermally to the device, also cools down and would thereupon actually close again automatically.

In the case of the four switches mentioned above, it is now ensured that said switching back into the cooled-down position does not occur such that the device to be protected, once being shutoff, can automatically switch on again. This is a safety function which is to avoid damage, as applies, for example, in the case of electric motors which are used as drive units.

It is also known to provide such temperature-dependent switches with a so-called self-holding resistor which is connected in parallel with the two counter contacts so that it takes over part of the load current when the switch opens. Ohmic heat, which is sufficient to hold the snap disc above its response temperature, is generated in said self-holding resistor.

Said self-holding, however, is only active for as long as the electric device is still switched on. As soon as the device is shut off from the supply circuit, no more current flows through the temperature-dependent switch either so that the self-holding function is cancelled.

After the electric device has been switched on again, the switch would be situated in the closed state again so that the device is able to heat up again, which could result in consequential damage.

Said problems are avoided in the case of the temperature-dependent switches disclosed in DE 10 2007 042 188 B3 and DE 10 2013 101 392 A1, where the self-holding function is not realized electrically but by means of a bistable spring part which comprises two stable geometric configurations in a temperature-independent manner, as is described in the above-cited documents.

In contrast to this, the snap disc is a bistable snap disc which assumes either a high-temperature configuration or a low-temperature configuration in a temperature-dependent manner.

In the case of DE 10 2007 042 188 B3 mentioned at the outset, the spring disc is a circular spring snap disc on the middle of which the contact member is fastened. The contact member is, for example, a movable contact part which is pressed by the spring snap disc against the first stationary counter contact which is arranged on the inside of a cover of the housing of the disclosed switch.

The spring snap disc presses by way of its edge against an inner bottom of a lower part of the housing which acts as a second counter contact.

In this way, the spring snap disc, which is itself electrically conducting, produces an electrically conducting connection between the two counter contacts.

The external connection of the known switch is effected, on the one hand, via the outer surface of the electrically conducting lower part and, on the other hand, via through-plating of the first stationary counter contact through the upper part on the outer surface thereof, where, for example, a solder connection can be provided.

The bistable snap disc, in the case of the disclosed switches, is a bi-metal snap disc which springs from its convex into a concave configuration when its response temperature is exceeded.

Centrally, the bi-metal snap disc comprises a through-opening by way of which it is put over the movable contact part which is fastened on the spring snap disc.

In its low-temperature position, the bi-metal snap disc lies loosely on the contact part. If the temperature of the bi-metal snap disc increases, it snaps over into its high-temperature position in which it presses with its edge against the inside of the upper part of the housing and, concurrently with its center onto the spring snap disc such that said spring snap disc snaps from its first into its second stable configuration, as a result of which the movable contact part is lifted off from the stationary counter contact and the switch is opened.

If the temperature of the switch cools down again, the bi-metal snap disc snaps into its low-temperature position again. In this case, it moves with its edge into abutment with the edge of the spring snap disc and with its center into abutment with the upper part of the housing. However, the actuating force of the bi-metal snap disc is not sufficient to let the spring snap disc spring back into its first configuration again.

The bi-metal snap disc only bends further once the switch has cooled down a lot such that it is finally able to press the edge of the spring snap disc onto the inner bottom of the lower part by such a distance that the spring snap disc snaps into its first configuration again and re-closes the switch.

The switch disclosed in DE 10 2007 042 188 B3 therefore, after being opened once, remains open until it has cooled down to a temperature below room temperature, for which purpose a cold spray, for example, may be used.

Although said switch meets the corresponding safety requirements in many applications, it has nevertheless been shown that as a result of bracing the bi-metal snap disc between the upper part of the housing and the edge of the spring snap disc, in rare cases the spring snap disc nevertheless springs back in an unwanted manner.

According to the above description, the disclosed switch conducts the load current of the device to be protected through the spring snap disc, which is only possible up to a certain current strength. Namely, in the case of higher current strengths, the spring snap disc is heated so much that said electrical self-heating results in the switching temperature of the bi-metal snap disc being achieved before the device to be protected has actually reached its inadmissible temperature.

DE 10 2013 101 392 A1 also discloses using a current transfer member as a contact member, for example in the form of a contact disc which is carried by the spring snap disc. Both stationary counter contacts are now arranged on the inner surface of the cover of the housing, as a result of the contact disc abutting with said two counter contacts an electrically conducting connection is produced between them.

In the case of said switch, the spring snap disc is fixed with its edge on the lower part of the housing, whilst the bi-metal snap disc is provided between the spring snap disc and the inner bottom of the lower part.

Below the response temperature of the bi-metal snap disc, the spring snap disc presses the contact disc against the two counter contacts. If the bi-metal snap disc snaps into its high-temperature position, it thus presses with its edge against the spring snap disc and pulls the spring snap disc away from the upper part by means of its center so that the contact disc moves out of abutment with the two counter contacts. So that this is geometrically possible, contact disc, spring snap disc and bi-metal snap disc are connected together captively by a centrally extending rivet.

When the temperature of the bi-metal snap disc drops again, it snaps back into its low-temperature position, but the spring disc remains in its assumed configuration as the bi-metal snap disc lacks a counter bearing for its edge so that it is not able to press the current transfer member against the two stationary counter contacts again.

Said switch therefore comprises a self-holding function due to the design. In rare cases, in the event of strong mechanical vibrations, the spring snap disc can spring back in an unwanted manner here too.

A temperature-dependent switch with a current transfer member realized as a contact bridge, where the contact bridge is pressed against two stationary counter contacts via a closing spring, is disclosed in DE 25 44 201 A1 which has already been mentioned at the outset.

The contact bridge is in contact via an actuating bolt with a temperature-dependent switching mechanism which consists of a bi-metal snap disc and a spring disc, both of which are clamped at their edges.

As with the switch disclosed in DE 10 2007 042 188 B3, the spring disc and the bi-metal snap disc are both bistable, the bi-metal snap disc in a temperature-dependent manner and the spring disc in a temperature-independent manner.

If the temperature of the bi-metal snap disc increases, it presses the spring disc into its second configuration in which it presses the actuating bolt against the contact bridge and, in this case, lifts said contact bridge from the stationary counter contacts against the force of the closing spring.

Even when the bi-metal snap disc cools down, the spring disc remains in said second configuration and holds the known switch open against the force of the closing spring.

Pressure can then be exerted from outside by means of a button onto the contact bridge such that, as a result, the spring disc is pressed back into its first stable configuration by means of the actuating bolt.

Along with the very complex design, said switch, on the one hand, comprises the disadvantage that in the open state, the spring disc lifts the contact bridge from the counter contacts against the force of the closing spring so that the spring disc, in its second configuration, has to overcome the force of the closing spring in a reliable manner. Because the closing spring, however, in the closed state ensures the secure abutment of the contact bridge against the counter contacts, a spring disc with a very high degree of stability is necessary here in the second configuration.

A further switch with three switching positions is disclosed in DE 86 25 999 U1 which has already been mentioned. A flexible tongue, which is clamped-in at one end and carries a movable contact part at its free end, which contact part interacts with a fixed counter contact, is provided in the known switch.

A calotte is realized on said flexible tongue, which calotte is pressed into its second configuration, in which it distances the movable contact from the stationary counter contact, by means of a bi-metal plate which is also fastened on the flexible tongue.

In the case of said switch, the calotte has to hold the movable contact part at a distance from the fixed counter contact against the closing force of the flexible tongue which is clamped-in at one end so that the calotte has to apply a high actuating force in its second configuration.

The known switch consequently comprises the above-discussed disadvantages, namely that high actuating forces have to be overcome, which leads to high production costs and to a non-secure state in the cooled-down position.

SUMMARY OF THE INVENTION

In view of the above, it is one object of the present invention to develop the switch mentioned at the outset further in such a manner that, with a structurally simple design, it ensures secure interruption of the power circuit even with the switch in the cooled-down position and in the event of strong vibrations.

These and other objects are achieved according to the invention in that the closing lock locks the temperature-dependent switching mechanism permanently in the second switching position thereof in a mechanical manner.

When the closing lock locks the switching mechanism permanently in a mechanical manner, the switching mechanism cannot close again after it has been opened once, even when strong vibrations or temperature fluctuations occur. As a result of the mechanical locking of the temperature-dependent switching mechanism, the switch is consequently also locked mechanically, which is used synonymously within the framework of the present application.

The closing lock is preferably realized by latching between the contact member and the housing of the switch or by resilient tongues which change their position when the switch is opened and assume a position such that they act as spacers which come to lie between the contact member or the spring disc or snap disc carrying said contact member and a component that lies above the spring disc or snap disc.

The temperature-dependent switching mechanism includes a temperature-dependent snap member, preferably a bi-metal snap disc, which brings about the opening of the switching mechanism in a conventional manner by lifting the contact member from the counter contact. According to the invention, the once-opened switching mechanism is then locked in the open state.

As is often the case, however, the temperature-dependent switching mechanism can additionally comprise a bistable spring disc which brings about the closing force and consequently the contact pressure between the movable contact member and the counter contact with the switch closed. As a result, the bi-metal snap disc is relieved from mechanical strain, which has a positive influence on its service life and on the long-term stability of the response temperature.

In view of the above, the temperature-dependent switching mechanism may comprise a temperature-dependent snap disc with a geometric high-temperature configuration and a geometric low-temperature configuration as well as a bistable spring disc, at which the contact member is arranged, wherein the spring disc comprises two geometric configurations which are stable in a temperature-independent manner and in its first configuration presses the contact member against the first counter contact and in its second configuration holds the contact member at a spacing from the first counter contact.

The snap disc, when transitioning from its low-temperature configuration into its high-temperature configuration, may be supported by its edge at a part of the switch and, in this case, acts on the spring disc such that it snaps from its first into its second stable configuration, further preferably the snap disc and the spring disc may be fixed to the contact member via their respective centers.

The advantage here is that largely common temperature-dependent switching mechanisms can be used for the novel switch so that the structural expenditure on starting serial production of the novel switch is low.

According to one object, the snap disc is fixed on the contact member and a space is provided for the edge of the snap disc, into which space the edge projects at least in part when the snap disc re-assumes its low-temperature configuration with the spring disc being in its second configuration.

Said design comprises the advantages disclosed in above-mentioned DE 10 2013 101 392 A1. When the snap disc snaps back again into its low-temperature position, its edge then moves into the space in which no abutment is provided for it such that it is not able to push the spring disc back again into its first configuration.

Even strong mechanical vibrations do not result here in the spring disc springing back again into its first configuration in which it would re-close the switch, being prevented from doing so according to the invention by the closing lock.

Without said space, that is to say in a design of the switch which serves, for example in DE 10 2013 101 392 A1 which is mentioned at the outset, as the starting point of that invention, when springing back into its low-temperature configuration, the bi-metal snap disc would exert pressure onto the spring disc which would allow said spring disc to snap into its other stable geometric configuration again. However, said operation is prevented according to the invention by the closing lock.

If then in a further development, the space is provided for the edge of the bi-metal snap disc in addition to the mechanical locking by means of the closing lock, in the first instance there is no generation of closing pressure which the closing lock has to absorb. As shown in DE 10 2013 101 392 A1, the switch remains permanently open.

If, however, strong mechanical vibrations result in the bi-metal snap disc springing back into its low-temperature configuration, the mechanical locking provided according to the present invention nevertheless holds the switch open.

In said further development, the closing lock only has to absorb the closing pressure in rare cases, which further increases the reliability of the novel switch.

In this case, the contact member may include a movable contact part which interacts with the first counter contact, and the spring disc may interact with the second counter contact, the spring disc may preferably communicate electrically with the second counter contact via its edge and at least in its first configuration.

Said configuration is already disclosed in principle in DE 10 2007 042 188 B3 or DE 10 2013 101 392 A1. It results in the snap disc not being loaded with current in any position but the load current of the electrical device to be protected flowing through the spring disc.

In another embodiment, the contact member includes a current transfer member which interacts with both counter contacts.

The advantage here is that the novel switch is able to conduct considerably higher currents than the switch disclosed in DE 10 2007 042 188 B3. The contact member, namely with the switch in the closed state, ensures the electrical short circuit between the two counter contacts such that not only the snap disc but also the spring disc now no longer conducts the load current, as is already disclosed in principle in DE 10 2013 101 392 A1.

According to another object, the switch includes a housing on which the two counter contacts are provided, and in which the switching mechanism is arranged.

Said measure is known per se, it ensures that the switching mechanism is protected from the ingress of contaminants. The housing can be an individual housing of the switch or a pocket on the device to be protected from overheating.

When the spring disc is fixed by way of its edge on the housing and the contact member is a movable contact part, the edge of the spring disc is always connected fixedly to the housing so that good electrical contact resistance is ensured here. Consequently, the novel switch is able to conduct larger currents than the switch disclosed in DE 10 2007 042 188 B3, where the contact resistance to the lower part is also determined by the contact pressure of the spring disc itself.

When a current transfer member is used as a contact member, the fixing of the spring disc on the housing by way of its edge ensures that the contact member remains securely positioned in relation to the counter contacts.

According to still another object, the housing comprises a lower part which is closed by an upper part, wherein the first counter contact or either of the two counter contacts is arranged on an inner surface of the upper part.

Said measure is known per se structurally, it ensures, in the case of the novel switch, that when the upper part is being mounted on the lower part, the geometrically correct assignment between the counter contact or the counter contacts and the respective contact member is produced at the same time.

The lower part may comprise an inner bottom and the space may be provided above the edge region of said inner bottom.

Said measure is advantageous in particular structurally for it makes it possible to provide, in the simplest manner, a switch which is temperature-dependent in a manner known per se with the three switching positions mentioned at the outset when a bistable spring part with two configurations which are stable in a temperature-independent manner is used here in each case.

Said measure, for example in the case of the switch disclosed in DE 196 23 570 A1 with the movable contact part, would not yet result in itself in the switch remaining open in the cooling position because the bi-metal snap disc is supported there namely by way of its edge against the external edge of the bottom and would thus press the spring part into its high-temperature position again.

The same situation results in the case of the switch disclosed in DE 10 2011 016 142 A1, where below a current transfer member a spring disc, which is clamped fixedly at its edge, and under this a snap disc, which is also supported on the inner of the bottom of the lower part by its edge, are arranged such that the snap disc would press a bistable spring part into its first configuration again during cooling.

In order to avoid this, without the now additionally provided space it would be necessary to design the actuating force of the spring disc in its second configuration so high that it is not possible to press it back into its first configuration by the snap disc.

In other words, in particular as a result of the snap disc being arranged between the spring disc and the bottom of the lower part, a space for the edge of the snap disc in its cooling position being provided on the edge of the bottom, the novel switch is however not only producible in a simple manner, it also remains securely open in its cooled-down position.

The lower part, in this case, can be produced from electrically conducting material and the upper part preferably from electrically insulating material, and the bistable snap disc may be a bi-metal or tri-metal snap disc.

According to one object, the closing lock interacts directly with the contact member.

The advantage here is that the closing lock acts in the center of the snap disc and, where applicable, of the spring disc, that is to say at the point where the closing force, which the closing lock has to absorb, is exerted. A further advantage is provided as a result of known temperature-dependent switching mechanisms being able to be used in the novel switch. Just the contact member has to be modified.

In this case, the closing lock may comprise at least one first latching member on the contact member and interact with a second latching member, which is arranged in the housing and is connected to said housing.

Said measure is advantageous structurally for along with the small structural modification to the contact member, only at least one other latching member is to be additionally provided in the housing.

The first latching member, in this case, can be arranged in the region of an outer surface of the contact member and/or of an inner surface in a bottom opening of the contact member, the first or second latching member preferably being able to be realized as a circumferential groove, as a circumferential bead, as a resilient tongue, a recess or a latching lug, the first latching member also being able to comprise latching lugs and/or resilient tongues which are arranged distributed on the circumference.

The first and/or second latching members, in this case, can be realized in a radially yielding manner.

This measure is also advantageous structurally for one or both latching members can be realized in a resilient manner and/or from an elastic material, which makes it possible for the two latching members to be able to move into engagement with one another without overcoming greater forces when the switch or the switching mechanism is opened for the first time.

According to a further object, the closing lock comprises at least one locking member which interacts with the contact member and with a component which is arranged between the upper part and the lower part.

Whilst the previously mentioned latching members are arranged, as it were, below the snap disc and where applicable spring disc, the locking members are arranged above the snap disc and where applicable spring disc and serve quasi as spacers which prevent the contact member moving into abutment again with the first counter contact once the switch has been opened, the locking member preferably being connected to the contact member or to a spring disc or snap disc which carries the contact member.

This measure is also advantageous structurally, the locking members, which act as spacers, additionally ensuring the switch is held open reliably.

According to one further object, the component includes a disc with a through-opening for the contact member, and the locking member comprises at least one radially outwardly resilient tongue, which sits under tension in the through-opening when the temperature-dependent switching mechanism is situated in its first switching position and which is supported against an underside of the disc when the temperature-dependent switching mechanism is situated in its second switching position.

The advantage here is that it is possible to use conventional temperature-dependent switching mechanisms, on the contact member of which and/or the spring disc or snap disc of which the locking member or locking members are also able to be mounted in retro. The insulating film, which serves as a seal and/or for electrical insulation and is present in any case between the upper part and the lower part of the housing, serves in this case as a disc.

According to other objects, the component is realized as a spacer ring, and the locking member comprises at least one radially outwardly resilient tongue which is arranged on the contact member, which is realized as a current transfer member, wherein the tongue abuts against an inner surface of the spacer ring under tension when the temperature-dependent switching mechanism is situated in its first switching position, and is supported on the spacer ring when the temperature-dependent switching mechanism is situated in its second switching position, or when the component is realized as a spacer ring, and the locking member comprises at least one radially inwardly resilient tongue which is arranged on an inner surface of the spacer ring and abuts under tension against the contact member realized as a current transfer member when the temperature-dependent switching mechanism is situated in its first switching position, and is supported on the current transfer member when the temperature-dependent switching mechanism is situated in its second switching position.

Such spacer rings are frequently added between the lower part and the upper part in temperature-dependent switches in order to reach the necessary installation height which enables a sufficiently large switching path between the counter contact and the contact member in order to ensure the necessary electrical insulation in the open switch.

The locking member, in this case, can comprise multiple resilient tongues arranged to form a ring which is arranged like a type of crown or feather duster on the contact member, the snap disc or spring disc or the spacer ring, and can also be provided in retro to existing switch designs without a large number of structural modifications.

Further advantages emerge from the description and the accompanying drawing.

It is to be understood that the features mentioned above and the features yet to be explained below are usable not only in the combination provided in each case but also in other combinations or standing alone without departing from the scope of the present invention.

BRIEF DESCRIPTION OF THE DRAWINGS

Embodiments of the invention are shown in the drawings and will be explained in more detail in the following description. In the drawings.

DESCRIPTION OF PREFERRED EMBODIMENTS

Figure 1:
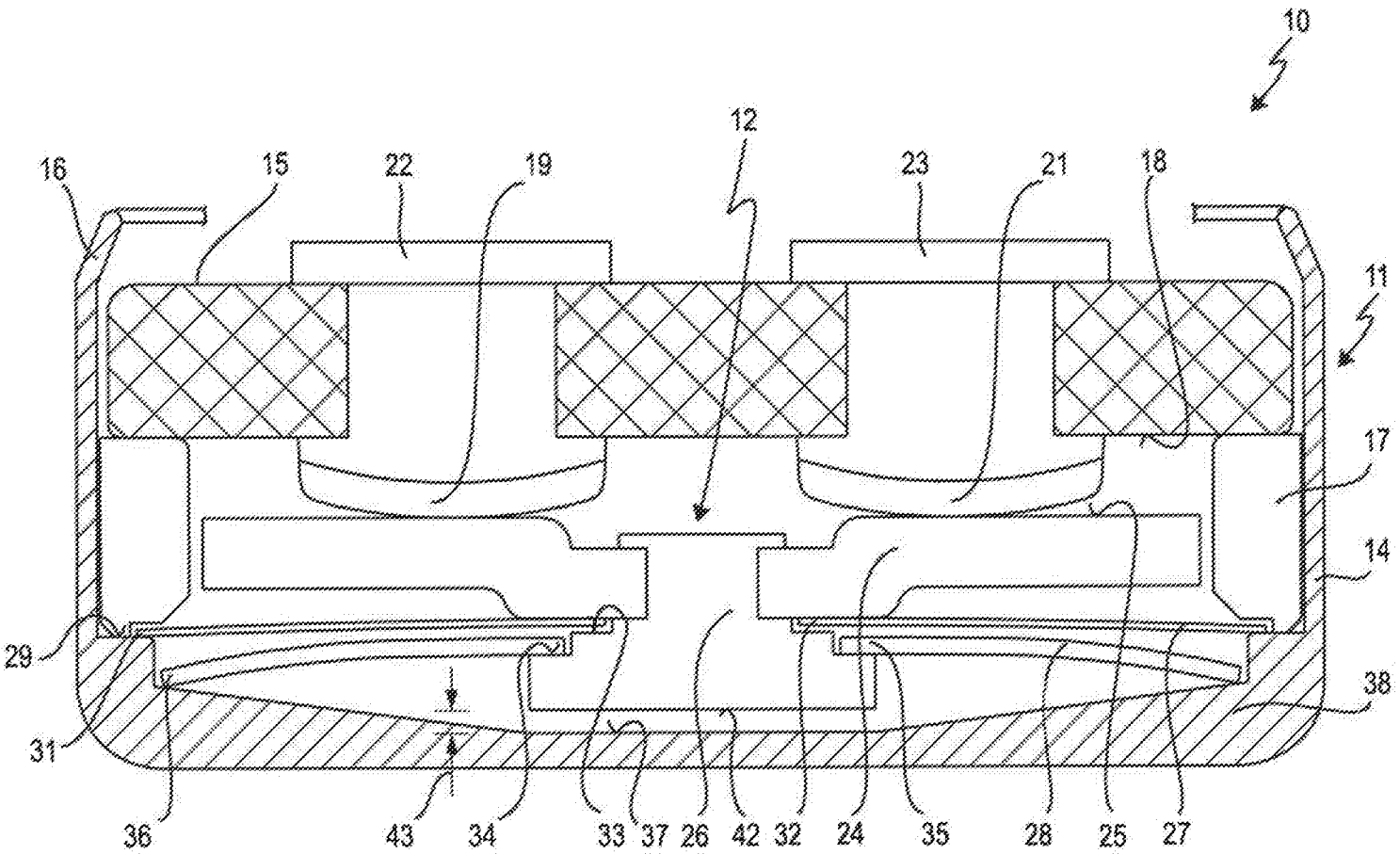
FIG. 1 shows a schematic side representation of a first embodiment of the novel switch in its low-temperature position.

FIG. 1 shows a schematic, sectioned side view of a switch 10 which is realized in a rotationally symmetrical manner in top view and preferably comprises a circular form.

The switch 10 comprises a housing 11 in which a temperature-dependent switching mechanism 12 is provided.

The housing 11 includes a pot-like lower part 14 which is produced from electrically conducting material and a flat, insulating upper part 15 which is held on the lower part 14 by means of a bent-over edge 16. For reasons of clarity, the bent-over edge 16 is not shown solidly right across the upper part 15.

A spacer ring 17, which holds the upper part 15 at a spacing from the lower part 14, is provided between the upper part 15 and the lower part 14.

The upper part 15 comprises an inner surface 18 on which a first stationary counter contact 19 and a second stationary counter contact 21 are provided. The counter contacts 19 and 21 are realized as rivets which extend through the upper part 15 and end on the outside in heads 22 or 23 which serve for the external connection of the switch.

The switching mechanism 12 includes, as a contact member, a current transfer member 24 which, in the shown embodiment, is a contact disc, the upper side 25 of which is coated in an electrically conducting manner so that in the case of the system shown in FIG. 1 it ensures an electrically conducting connection between the two counter contacts 19 and 21 at the counter contacts 19 and 21.

The current transfer member 24 is connected via a rivet 26, which is also to be seen as part of the contact member, to a bistable spring disc 27 and a bistable snap disc 28.

Figure 2:
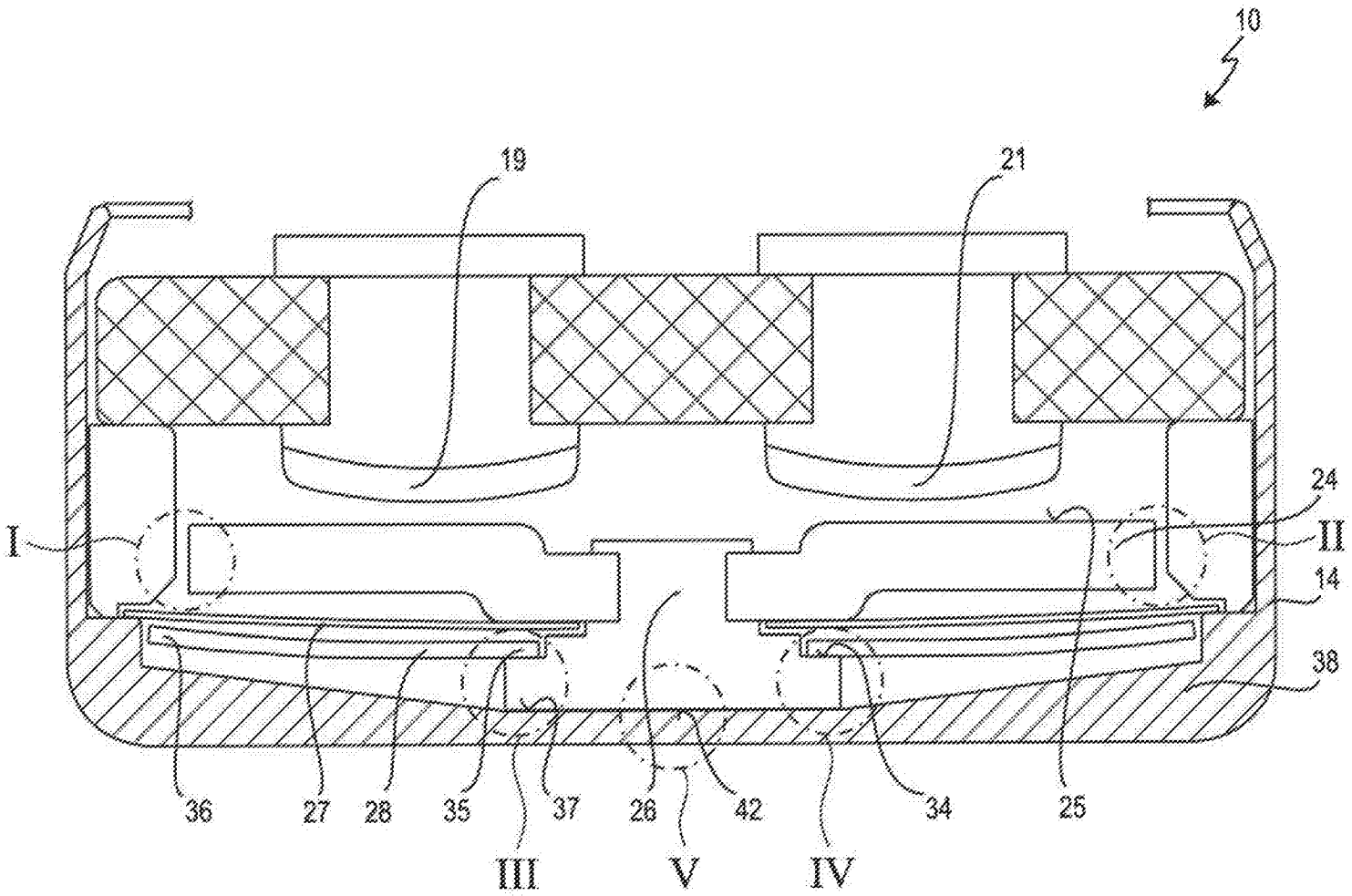
FIG. 2 shows a representation as FIG. 1, but with the novel switch in the high-temperature position.

The spring disc 27 comprises two temperature-independent configurations, the first configuration of which is shown in FIG. 1 and the second configuration in FIG. 2.

The snap disc 28 comprises two temperature-dependent configurations, namely its low-temperature configuration which is shown in FIG. 1 and its high-temperature configuration which is shown in FIG. 2.

A circumferential shoulder 29, on which the spacer ring 17 rests, is provided in the inside of the lower part 14. The spring disc 27 is clamped by way of its edge 31 between the shoulder 29 and the spacer ring 17, whilst it rests by way of its center 32 on a shoulder 33 on the rivet 26. The spring disc 27 is consequently clamped at its center 32 between the current transfer member 24 and the shoulder 33.

Another shoulder 34, on which the snap disc 28 rests by way of its center 35, can be seen in FIG. 1 further below and further radially outside on the rivet 26.

The center 35 rests freely on the shoulder 34.

The snap disc 28 lies freely above an inner bottom 37 of the lower part 14 by way of its edge 36.

According to FIG. 1, the inner surface 37 is realized as a wedge-shaped support shoulder 38 which ascends radially outwardly and serves, as in the case of the shoulder disclosed in DE 10 2011 016 142 A1, as a support surface for the edge 36.

The rivet 26 further comprises a bottom 42 which points to the inner bottom 37 but, in the low-temperature position of the switch 10 according to FIG. 1, is at a distance designated by reference numeral 43 from said inner bottom.

When the temperature of the snap disc 28 then increases, its edge 36 in FIG. 1 is lifted upward such that the snap disc 26 snaps from its convex position shown in FIG. 1 into its concave position shown in FIG. 2 in which its edge 36 is supported against a part of the switch 10, in this case against the spring disc 27, as can be seen in FIG. 2.

When transitioning from its low-temperature configuration in FIG. 1 into its high-temperature configuration in FIG. 2, the snap disc 28 is therefore supported by way of its edge 36 against the spring disc 27, pressing by way of its center 35 onto the shoulder 34 of the rivet 26 and, as a result, pressing the current transfer member 24 away from the stationary counter contacts 19 and 21 against the force of the spring disc 27.

As a result of said movement, the rivet 26 is placed by way of its bottom 42 onto the inner bottom 37 of the lower part 14, at the same time the spring disc 27 snapping from its first configuration shown in FIG. 1 into its equally stable second geometric configuration which is shown in FIG. 2.

Whilst the spring disc 27 holds the current transfer member 24 in abutment with the counter contacts 19 and 21 in its first configuration according to FIG. 1, it holds the current transfer member 24 at a distance from the counter contacts 19 and 21 in its second configuration according to FIG. 2 such that the switch 10 is open.

Whilst the switch 10 is in its closed low-temperature position in FIG. 1, it is situated in its open high-temperature position in FIG. 2.

When the temperature of the device to be protected and consequently the temperature of the switch 10 cools down again then, the snap disc 28 snaps from its high-temperature configuration according to FIG. 2 back again into its low-temperature configuration which it had already assumed in FIG. 1.

The snap disc 28 is situated in its low-temperature configuration again to which it has cooled on account of the cooling of the device to be protected. The edge 36 of the snap disc 28 has moved downward in FIG. 2 and now rests on the supporting shoulder 38.

The snap disc 28 will once again press the spring disc 27 into its first configuration when transitioning into its low-temperature configuration, as is the case with the switch according to DE 10 2011 016 142 A1.

However, a closing lock 39, which is arranged in the region of the circles I, II, III, IV and V indicated in FIG. 2, is provided according to the invention. For reasons of clarity, different embodiments of the closing lock 39 are shown in FIGS. 6 to 12.

Figure 3:
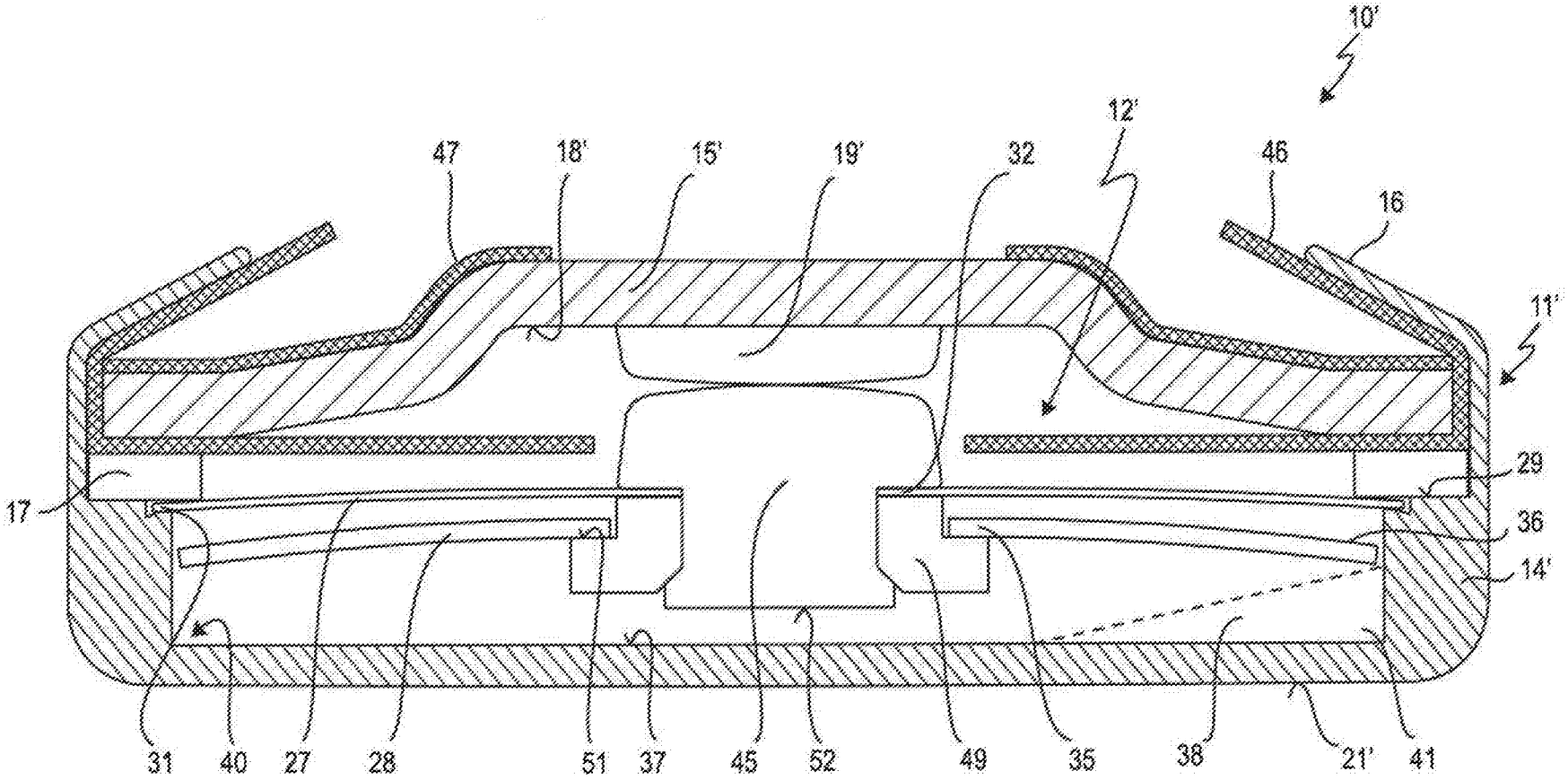
FIG. 3 shows a schematic side representation of a second embodiment of the novel switch in its low-temperature position.
Figure 4:
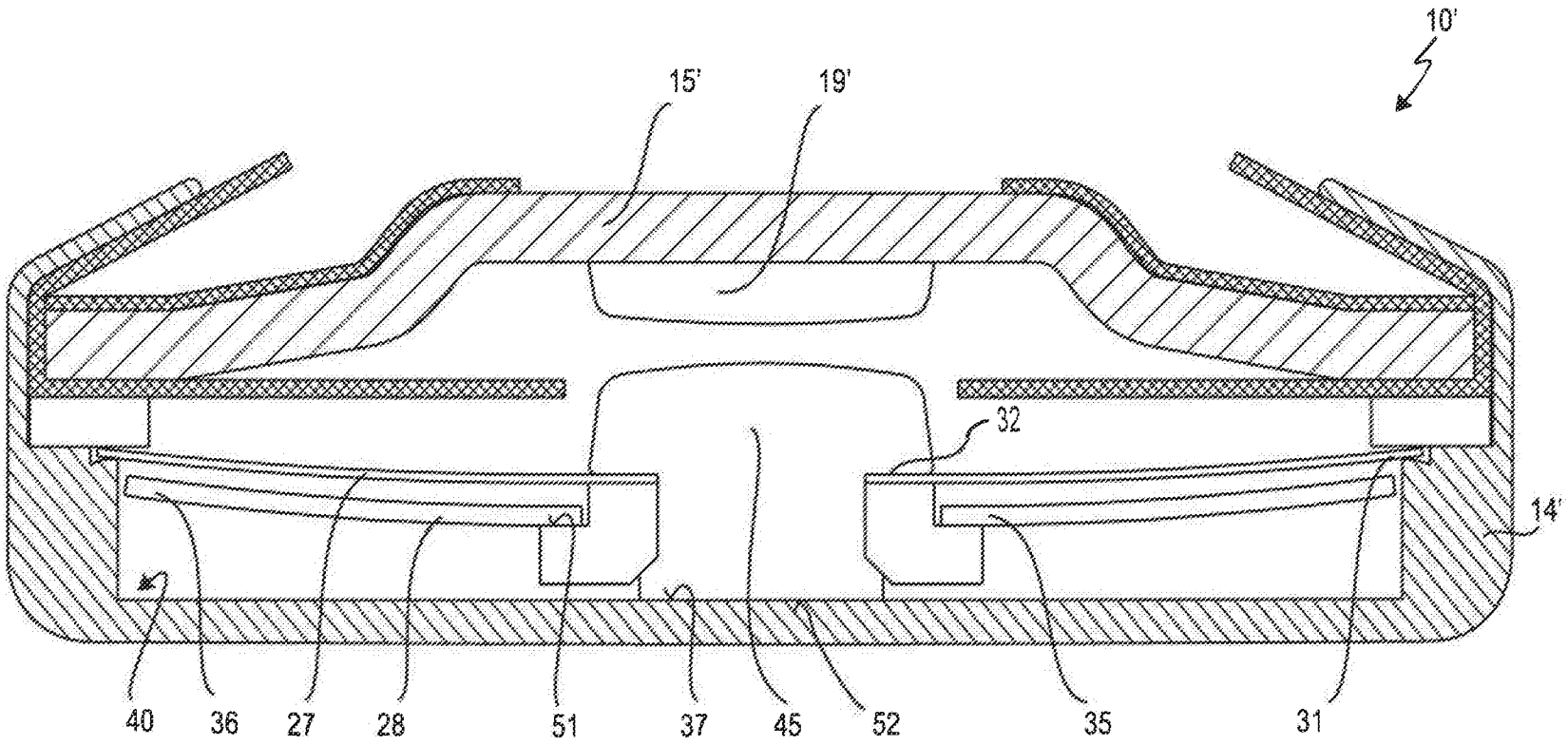
FIG. 4 shows a representation as in FIG. 3, but with the novel switch in the high-temperature position.
Figure 5:
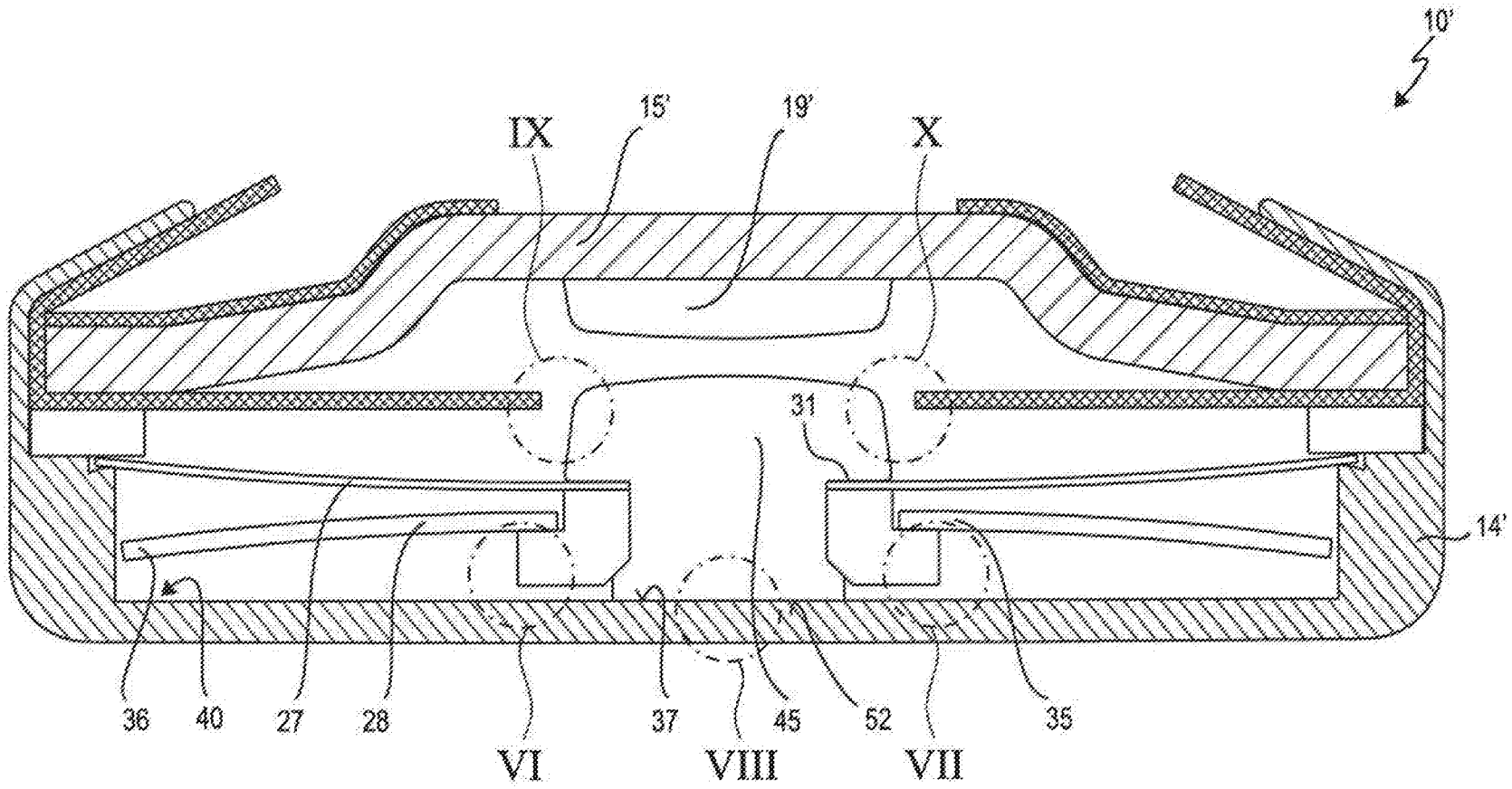
FIG. 5 shows a representation as FIGS. 3 and 4 of the novel switch in its cooled-down position.

Whilst a first embodiment of the novel switch 10 is shown in FIGS. 1 and 2, where a current transfer member 24 with rivet 26 is used as a contact member, FIGS. 3 to 5 show a second embodiment of the novel switch where a movable contact part 45, which is part of the switching mechanism 12', is used as a contact part.

The switch 10' from FIG. 3 once again comprises a pot-like lower part 14', a spacer ring 17 which carries the upper part 15' with the interposition of an insulating film 46 once again resting on the circumferential shoulder 29 of which pot-like lower part.

Lower part 14' and upper part 15' are produced here from electrically conducting material so that contact to an electrical device to be protected is able to be produced via their outer surfaces. The outer surfaces also serve at the same time for the electric external connection.

The upper part 15' is held once again on the lower part 14' by the bent-over edge 16 of said lower part, one more insulating layer 47 being attached on the outside of the upper part 15'.

The switching mechanism 12' also includes the spring disc 27 and the snap disc 28 here, the spring disc 27 being clamped by way of its edge 31 between the shoulder 29 and the spacer ring 17.

The spring disc 27 is fixed on the contact part 45 by way of its center 32, a ring 49 being pressed onto said contact part for this purpose.

The ring 49 comprises a circumferential shoulder 51, on which the snap disc 28 rests by way of its center 35.

In this way, the temperature-dependent switching mechanism 12' from FIG. 3 is a captive unit produced from contact member, spring disc 27 and snap disc 28 just as the switching mechanism 12 from FIGS. 1 and 2.

When assembling the switches 10 and 10', the switching mechanism 12, 12' is able to be placed directly into the lower part 14, 14' as a unit.

The movable contact part 45 interacts with a fixed counter contact 19' which is arranged on the inside of the upper part 15.

The outer surface of the lower part 14', which is produced from electrically conducting material, serves as a second counter contact 21'.

In the position shown in FIG. 3, the switch 12' is situated in its low-temperature position in which the spring disc 27 is situated in its first configuration and the snap disc 28 is situated in its low-temperature configuration.

The spring disc 27, in this case, presses the movable contact part 45 against the stationary counter contact 19'.

The movable contact part 45 comprises a bottom 52, which points to the inner bottom 37 of the lower part 14' and is at a distance from the same, as is comparable with the distance 43 in FIG. 1.

A circumferential free space 40, which is provided in an edge region 41 of the inner bottom 37, is provided below the edge 36 of the snap disc 28

The switch 10' described in this respect comprises roughly the same geometric features as an embodiment of a switch from DE 10 2013 101 392 A1 which was mentioned at the outset.

In the case of the known switch, however, a wedge-shaped, circumferential supporting shoulder 38, which comprises the same function as the circumferential shoulder 29 in the case of the shoulder from the current FIGS. 1 and 2, is situated in the edge region 41. Said shoulder 38 is not provided in the novel switch 10'.

Because the spring disc 27 is clamped by way of its edge 31 between spacer ring 17 and shoulder 29, it is connected there to the lower part 14' in an electrically conducting manner with very low contact resistance.

The spring disc 27 is clamped at its center 32 between the movable contact part 45 and the ring 49 so that, here too, a contact resistance that is very low electrically prevails.

With the switch 10' in the closed low-temperature position according to FIG. 3, an electrically conducting connection is consequently produced between the counter contact 19' and the counter contact 22' via the movable contact part 45 and the spring disc 27.

The snap disc 28, in this case, rests freely on the supporting shoulder 38 below the spring disc 27.

If the temperature of the device to be protected and consequently the temperature of the snap disc 28 is then increased, said snap disc snaps from the convex low-temperature configuration shown in FIG. 3 into its concave high-temperature configuration which is shown in FIG. 4.

During said snapping action, the snap disc 28 is supported by way of its edge 36 on part of the switch 10', in this case on the edge 31 of the spring disc 27.

By way of its center 35, the snap disc 28, in this case, presses onto the shoulder 51 and consequently lifts the movable contact part 45 from the stationary contact part 19'.

As a result, it deflects the spring disc 27 downward at its center 32 at the same time so that the spring disc 27 snaps from its first stable geometric configuration in FIG. 3 into its second geometrically stable configuration in FIG. 4.

In said second configuration, the spring disc 27 presses the bottom 52 of the contact part 45 against the inner bottom 37 of the lower part 14'.

FIG. 4 therefore shows the high-temperature position of the switch 10' in which said switch is open.

If the device to be protected and consequently the snap disc 28 then cool down again, the snap disc 28 snaps into its low-temperature position again, as shown for example in FIG. 3. To this end, the edge 36 in FIG. 4 is moved downward and consequently into the free space 40.

The switch 10' is then situated in its cooled-down position which is shown in FIG. 5.

The spring disc 27 is still in its geometrically stable second configuration in which it holds the contact part 45 at a distance from the counter contact 19', the contact part 45 resting by way of its bottom 52 on the inner bottom 37 of the lower part 14.

The snap disc 28 is situated in its low-temperature configuration again, having moved with its edge 36 into the free space 40. The snap disc 28 is consequently not capable of pressing the contact part 45 or the spring disc 27 upward at its center 32 in FIG. 5.

Closing locks 39, which are arranged in the region of the circles VI, VII, VIII, IX and X indicated in FIG. 5, are also provided again in the case of the switch 10' from FIGS. 3 to 5. For reasons of clarity, schematic representations of different embodiments of the closing locks 39 used here are also shown in FIGS. 6 to 11.

It is the job of the closing locks 39 to lock the temperature-dependent switching mechanism 12, 12' permanently in the high-temperature position in a mechanical manner in a switch 10, 10' that has been opened once such that it is not able to close again even when the snap disc 28 cools down.

Whilst in the case of the switch 10 in FIGS. 1 and 2 the closing locks 39 have to absorb the closing pressure exerted by the cooled snap disc 28 in a permanent manner, said closing pressure does not exist in the case of the switch 10' in FIGS. 3 to 5 because the edge 36 of the snap disc 28 does not find any supporting shoulder 38 but rather comes to rest in the free space 40.

Figure 6A:
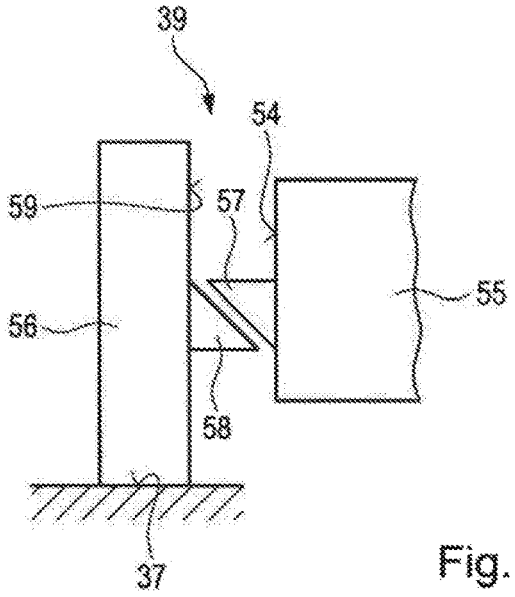
FIGS. 6*a* and 6*b* show a first embodiment of a closing lock which can be used with the switches in FIGS. 1 to 5.

FIG. 6 shows in a schematic side view a contact member 55 which comprises an outer surface 54 and is to symbolize the movable contact part 45 from FIG. 5, the rivet 26 from FIG. 2 or the current transfer member 24 from FIG. 2. A component 56 of the switch 10 or 10', which symbolizes a latching carrier in FIG. 6*a* which is arranged on the bottom 37, and the spacer ring 17 of the switch 10 in FIG. 2, is indicated parallel to the outer surface 54. The component 56 is therefore arranged in the switch 10, 10' and is connected to said switch.

The closing lock 39, which interacts here directly with the contact member 55, is realized between component 56 and contact member 55. The closing lock 39 includes a first latching member, which is arranged on the outer surface 54, and a second latching member, which is attached to the component 56, more precisely to the outer surface 59 thereof.

Figure 6B:
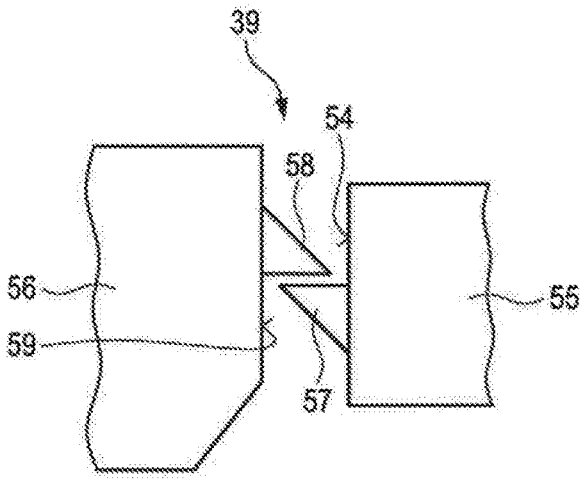

In FIG. 6 the latching members are realized as latching lugs 57, 58 which slide past one another when the switch is opened, to which end they are realized in a resilient or elastically yielding manner. In FIG. 6*a* the switch 10, 10' is situated in the closed state according to FIG. 1 or 3, and in FIG. 6*b* in the open state according to FIG. 2, 4 or 5.

In FIG. 6*b* the latching lugs 57, 58 are latched together such that the contact member 55 is no longer able to be moved upward (that is to say to close the switch 10, 10') because it is permanently locked to the component 56 in a mechanical manner.

Figure 7A:
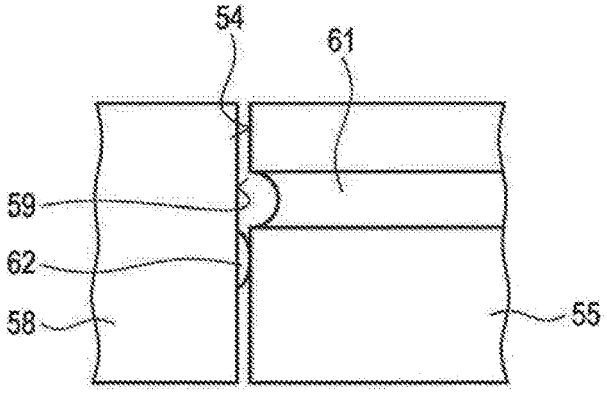
FIGS. 7*a* and 7*b* show a second embodiment of a closing lock which can be used with the switches in FIGS. 1 to 5.
Figure 7B:
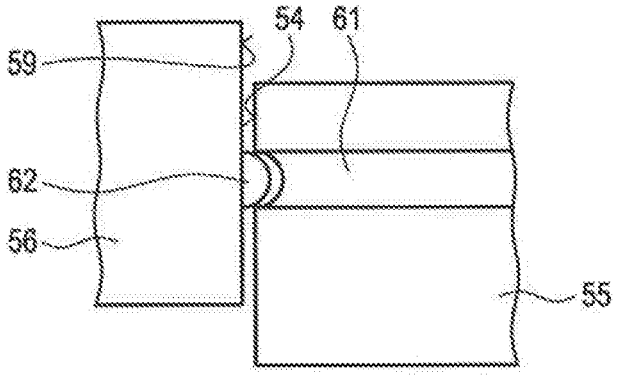
Figure 8A:
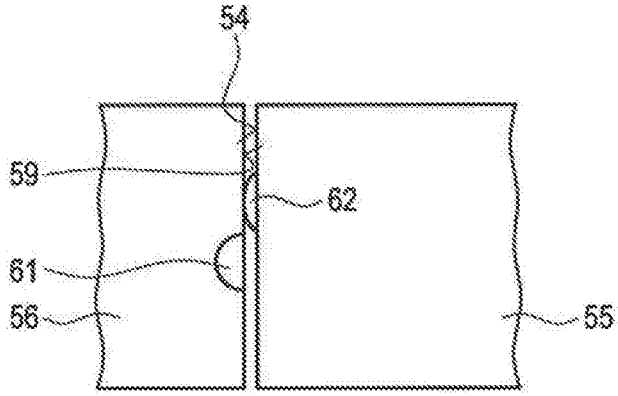
FIGS. 8*a* and 8*b* show a third embodiment of a closing lock which can be used with the switches in FIGS. 1 to 5.
Figure 8B:
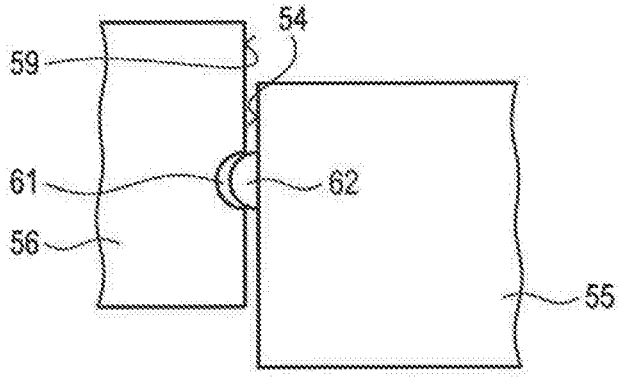

The representations in FIGS. 7 and 8 correspond to those from FIG. 6, only bar the latching members being realized as circumferential groove 61 or circumferential bead 62. In FIG. 7 the groove 61 is arranged on the contact member 55 and in FIG. 8*a* on the component 56.

The bead 61 consists of elastic material and is consequently radially yielding. It slides along the outer surface 54 or 59 when the switch 10, 10' is opened until it engages in the groove 62 and locks the contact member 55 permanently to the component 56 in a mechanical manner.

Figure 9A:
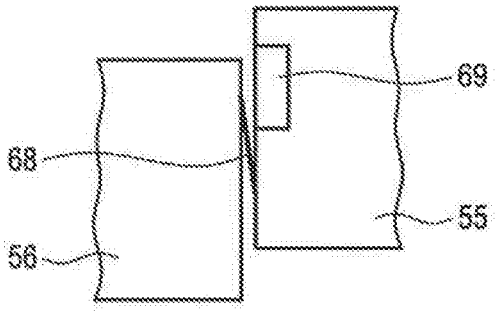
FIGS. 9*a* and 9*b* show a fourth embodiment of a closing lock which can be used with the switches in FIGS. 1 to 5.
Figure 9B:
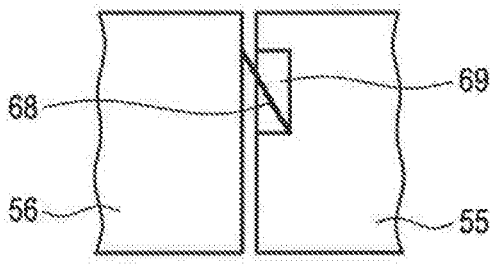
Figure 10A:
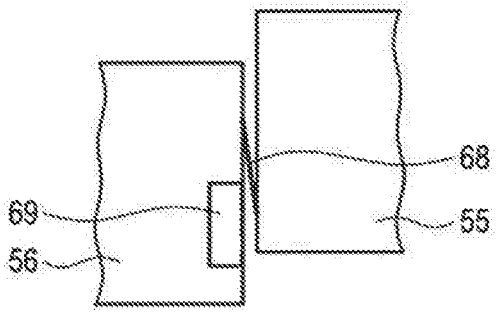
FIGS. 10*a* and 10*b* show a fifth embodiment of a closing lock which can be used with the switches in FIGS. 1 to 5.
Figure 10B:
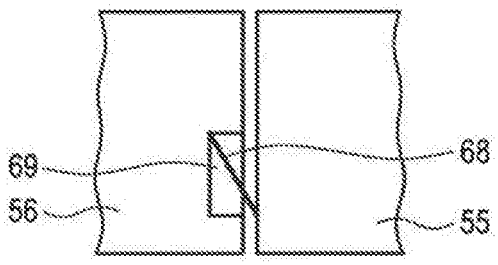

The representations in FIGS. 9 and 10 also correspond to those from FIG. 6, only bar the latching members being realized here as a locking member in the form of a resilient tongue 68 or recess 69. The recess 69 is arranged on the contact member 55 in FIG. 9 and on the component 56 in FIG. 10.

The resilient tongue 68 is radially yielding. It abuts against the outer surface 54 or 59 under tension and slides along past the outer surface 54 or 59 when the switch 10, 10' is opened until it engages in the recess 69 and locks the contact member 55 permanently on the component 56 in a mechanical manner.

The closing locks 39 from FIGS. 6 to 10 can be realized in the circles I to IV, VI and VII.

Figure 11:
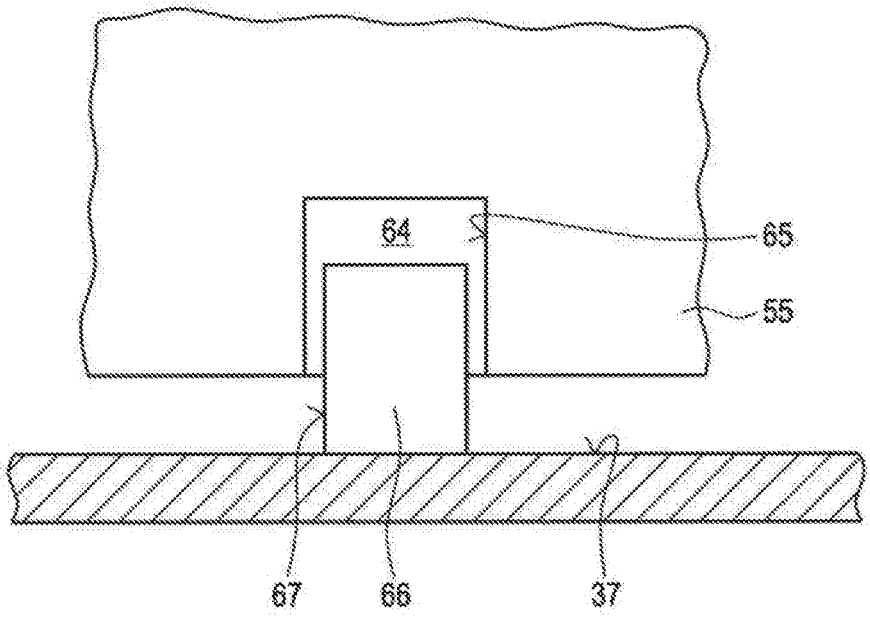
FIG. 11 shows a sixth embodiment of a closing lock which can be used with the switches in FIGS. 1 to 5.

FIG. 11 shows a schematic side view of a contact member 55 which comprises a preferably central bottom opening 64 and is to symbolize the movable contact part 45 from FIG. 3 or the rivet 26 from FIG. 1. The bottom opening 64 comprises an inner surface 65 and sits on a journal 66 which is fastened to the inner bottom 37 of the switch 10, 10' and comprises an outer surface 67.

The latching members 57, 58; 61, 62 from FIGS. 6 to 10 can be arranged on the inner surface 65 and the outer surface 67 in order to lock the contact member 55 mechanically to the bottom 37 when the switch 10, 10' has moved for the first time into its high-temperature position in which the contact member rests on the bottom 37.

The locking lock 39 from FIG. 11 can be realized in the circles V and VIII.

Figure 12A:
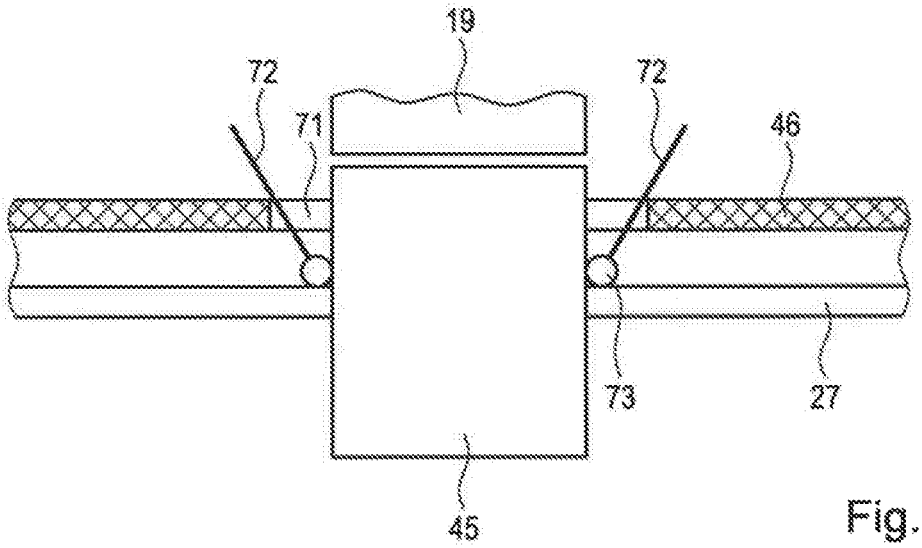
FIGS. 12*a* and 12*b* show a seventh embodiment of a closing lock which can be used with the switch in FIGS. 3 to 5.
Figure 12B:
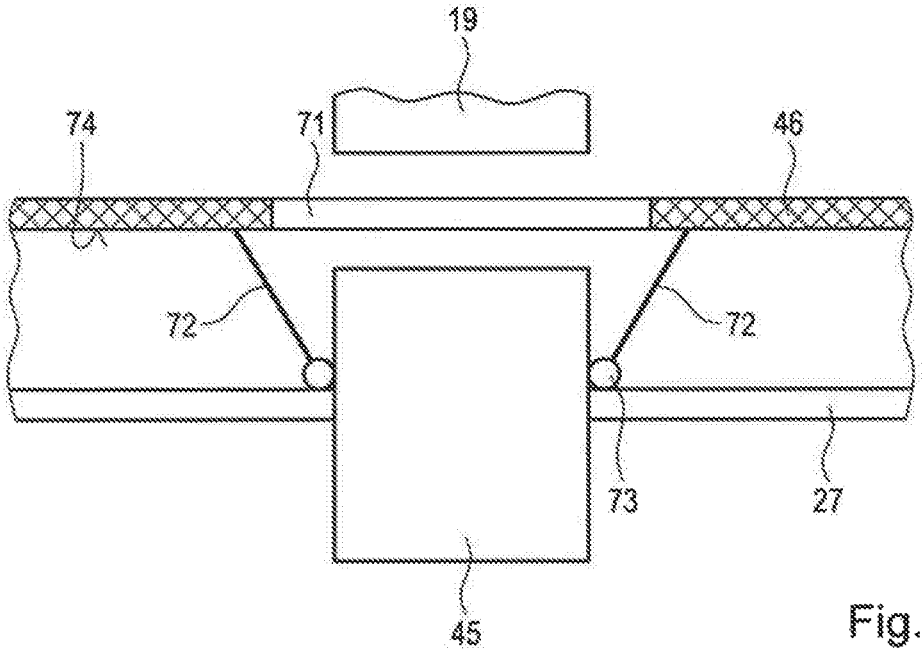

FIG. 12 shows a schematic side view of details of the switch 10' from FIGS. 3 to 5 in the region of the movable contact part 45, FIG. 12*a* corresponding to the low-temperature position and FIG. 12*b* to the high-temperature position.

The insulating film 46, in which a through-opening 71 is provided, through which the contact part 45 moves in abutment with the counter contact 19, can be seen above the contact part 45. Multiple locking members 72, which are realized as flexible tongues and are arranged in the manner of a crown or a feather duster, are arranged distributed around the contact part 45.

The flexible tongues extend upward at an angle from a ring 73, by means of which they are fastened to the contact part 45 and/or to the spring disc 27. In the low-temperature position in FIG. 12*a*, the flexible tongues extend through the through-opening 71 and are mechanically functionless.

When the switch 10' opens, the contact part 45 is moved downward into the high-temperature position in FIG. 12*b*. In this case, the flexible tongues are released from the through-opening 71 and are moved radially outward under the underside 74 of the insulating film 46.

When the switch 10' cools down again and the spring disc 27 would snap into its low-temperature configuration again on account of a strong vibration, the switch would nevertheless not be able to re-close because the locking members 72 act as spacers and prevent the contact part 45 from moving upward.

The switch 10' is locked permanently in its high-temperature position in a mechanical manner in this way too.

The closing lock 39 from FIG. 12 can be realized in the circles IX and X.

Therefore, what is claimed is:

1. A temperature-dependent switch comprising:

a first stationary counter contact;

a second stationary counter contact;

a temperature-dependent switching mechanism having a first switching position and a second switching position, wherein:

the temperature-dependent switching mechanism comprises a contact member, a temperature-dependent snap disc having a geometric high-temperature configuration and a geometric low-temperature configuration, and a temperature-independent spring disc at which the contact member is arranged, the spring disc has a first geometric configuration and a second geometric configuration, and the temperature-dependent switching mechanism is configured so that:

in the first switching position, the spring disc is in the first geometric configuration and presses the contact member against the first stationary counter contact and produces an electrically conducting connection between the two stationary counter contacts via the contact member, and in the second switching position, the spring disc is in the second geometric configuration and holds the contact member spaced apart from the first stationary counter contact;

a housing in which the two stationary counter contacts are provided, and in which the switching mechanism is arranged; and a closing lock that permanently locks the temperature-dependent switching mechanism in a mechanical manner, when the switching mechanism is in the second switching position, so as to prevent the switching mechanism once having moved to the second switching position from moving back to the first switching position, wherein:

the closing lock comprises at least one first latching member arranged on the contact member and interacting with a second latching member, the first latching member is arranged in the housing, the second latching member is arranged in and connected to the housing, when the switching mechanism moves from the first switching position to the second switching position, at least one of the latching members radially and elastically yields to allow the latching members to slide into engagement with one another such that the contact member is permanently locked to the housing, and therefore the switching mechanism is permanently locked in the second switching position, and the latching members are selected from a group consisting of a circumferential groove, a circumferential bead, a resilient tongue, a recess, and a latching lug.

2. The switch of claim 1, wherein:

the spring disc is a bistable spring disc, and the first and second geometric configuration are stable in a temperature-independent manner.

3. The switch of claim 2, wherein:

the snap disc has an edge, and when transitioning from its geometric low-temperature configuration into its geometric high-temperature configuration, the snap disc is supported by its edge at a part of the switch and acts on the spring disc in such a way that the spring disc snaps from its first into its second geometric configuration.

4. The switch of claim 3, wherein the snap disc and the spring disc each have a center and are fixed to the contact member via their respective center.

5. The switch of claim 2, wherein:

the contact member includes a movable contact part that interacts with the first stationary counter contact, and the spring disc interacts with the second stationary counter contact.

6. The switch of claim 5, wherein the spring disc has an edge and is in electrical contact with the second stationary counter contact via the edge, at least when the spring disc is in the low-temperature configuration.

7. The switch of claim 1, wherein the contact member includes a current transfer member that interacts with the first and second stationary counter contacts.

8. The switch of claim 1, wherein:

the housing comprises a lower part and an upper part having an inner surface and closing the lower part, and the first stationary counter contact is arranged on the inner surface of the upper part.

9. The switch of claim 8, wherein the second stationary counter contact is arranged on the inner surface of the upper part.

10. The switch of claim 1, wherein the snap disc is one of a bi-metal snap disc and a tri-metal snap disc.

11. The switch of claim 1, wherein the closing lock interacts directly with the contact member.

12. The switch of claim 1, wherein the first latching member is arranged on an outer surface of the contact member.

13. The switch of claim 1, wherein the first latching member is arranged on an inner surface in a bottom opening of the contact member.

14. The switch of claim 8, wherein the closing lock comprises at least one locking member that interacts with the contact member and with a component that is arranged between the upper part and the lower part of the housing.

15. The switch of claim 14, wherein:

the component includes a component disc with a through-opening for the contact member, the locking member comprises at least one radially outwardly resilient tongue, the tongue sits in the through-opening under tension when the temperature-dependent switching mechanism is in its first switching position, and the tongue is supported on an underside of the component disc when the temperature-dependent switching mechanism is in its second switching position.

16. The switch of claim 14, wherein the locking member is connected to the contact member.

17. The switch of claim 14, wherein:

the locking member is connected to one disc of a spring disc and a snap disc, and the one disc carries the contact member.

18. The switch of claim 14, wherein:

the component is configured as a spacer ring, the locking member comprises at least one radially outwardly resilient tongue that is arranged on the contact member which is configured as a current transfer member, the tongue abuts against an inner surface of the spacer ring under tension when the temperature-dependent switching mechanism is in its first switching position, and the tongue is supported on the spacer ring when the temperature-dependent switching mechanism is in its second switching position.

19. The switch of claim 14, wherein:

the component is configured as a spacer ring, the locking member comprises at least one radially inwardly resilient tongue that is arranged on an inner surface of the spacer ring, the tongue abuts under tension against the contact member, which is configured as a current transfer member, when the temperature-dependent switching mechanism is in its first switching position, and the tongue is supported on the current transfer member when the temperature-dependent switching mechanism is in its second switching position.

20. The switch of claim 1, wherein the latching members are latching lugs.

* * * * *